US005234213A

United States Patent [19]

Chen

[11] Patent Number: 5,234,213

[45] Date of Patent: Aug. 10, 1993

[54] PAPER TURNOVER APPARATUS FOR TURNING OVER PRINTED PAPERS IN A PRINTER

[75] Inventor: Ying-Chic Chen, Hsinchu, Taiwan

[73] Assignee: Industrial Technology Research Institute, Hsinchu, Taiwan

[21] Appl. No.: 683,970

[22] Filed: Apr. 11, 1991

[51] Int. Cl.[5] ..... B65H 39/10

[52] U.S. Cl. ..... 271/303; 271/65; 271/186

[58] Field of Search ..... 271/65, 184, 185, 186, 271/225, 302, 303

[56] References Cited

U.S. PATENT DOCUMENTS 4,750,016 6/1988 Kusumoto et al. ..... 271/65 X

FOREIGN PATENT DOCUMENTS 0075565 3/1990 Japan ..... 271/303

*Primary Examiner*—H. Grant Skaggs
*Assistant Examiner*—Carol Lynn Druzbick
*Attorney, Agent, or Firm*—Darby & Darby

[57] ABSTRACT

The present invention discloses an apparatus disposed in a printer for turning over printed papers, which is capable of guiding printed papers to move toward a first paper receiving tray or a second paper receiving tray so as to pile the printed papers thereon with face down or face up. The apparatus includes a shaft disposed within the printer which is capable of being pivotally rotated around its longitudinal axis; a guiding means fixed on the shaft, having a first guide surface for guiding printed papers to move toward the first paper receiving tray and a second guide surface for guiding printed papers to move toward the second paper receiving tray, the first and second guide surfaces are disposed in such a way that only one of the first and second guide surfaces, in one time, is guided to face printed papers when the shaft is pivotally rotated around its longitudinal axis; and a crank capable of being urged by the first paper receiving tray. The gravitation center of the guiding device and the shaft are eccentric to the longitudinal axis of the shaft, so that the gravitational force of the guiding device and the shaft always drive the shaft to rotate to a first attitude that the first guide surface faces printed papers to guide the printed papers to move toward the first paper receiving tray, and the crank will guide the shaft to rotate to a second attitude that the second guide surface faces printed papers to guide the printed papers to move toward the second paper receiving tray when the first paper receiving tray urges the crank.

3 Claims, 8 Drawing Sheets

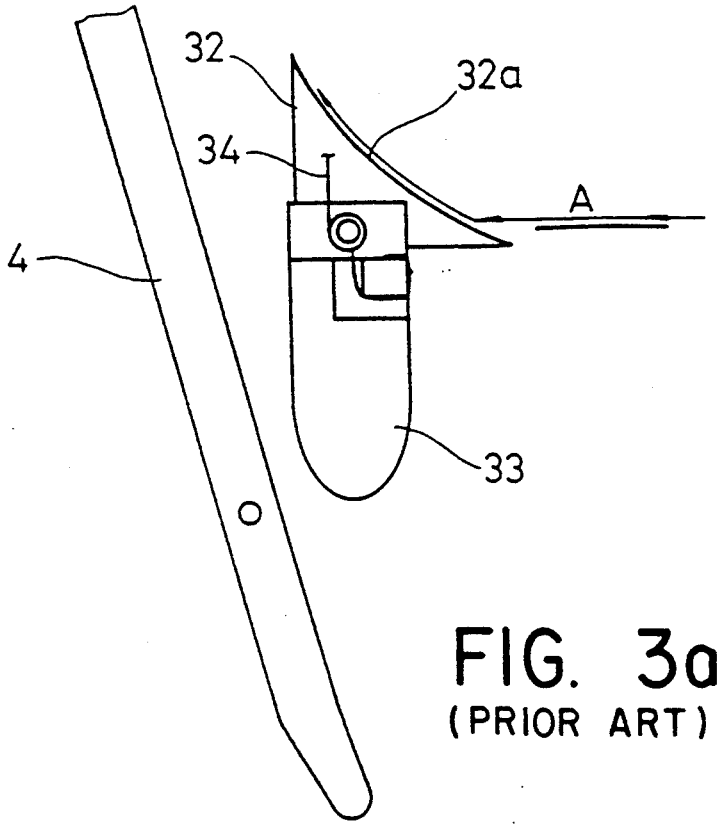
FIG. 3a
(PRIOR ART)
FIG. 3b
(PRIOR ART)
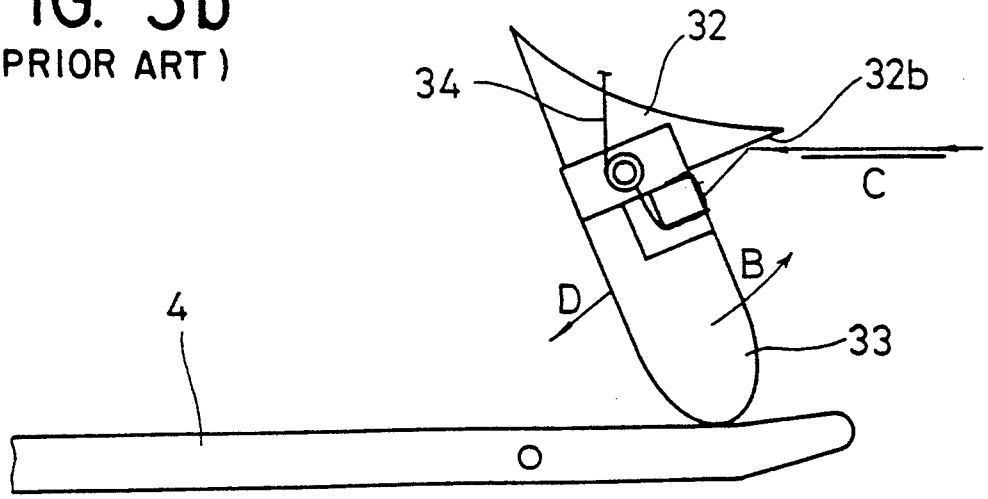

PAPER TURNOVER APPARATUS FOR TURNING OVER PRINTED PAPERS IN A PRINTER

BACKGROUND OF THE INVENTION

The present invention relates generally to an apparatus disposed in a printer for turning over printed papers, and particularly to a paper turnover apparatus for turning printed papers to a face-up or face-down state.

Conventional printers, particularly laser printers, are provided with a paper turnover apparatus for turning over printed papers, so that printed papers can be, in sequence, piled up on a paper receiving tray with face up or face down. FIG. 1*a* is a simplified diagram showing that papers to be printed are being transferred through a conventional printer and being disposed in a paper receiving tray with face up. As shown in FIG. 1*a*, papers to be printed are transferred through a transfer guide area 1 and a fuser area 2 for heating the papers passing therethrough and fusing carbon powders on the papers. Then, papers are transferred to the paper receiving tray 4 from under the paper guide 3. FIG. 1*b* is a simplified diagram showing that papers to be printed are being transferred through a conventional printer and being disposed in a paper receiving tray with face down. As shown in FIG. 1*b*, papers to be printed are transferred through a transfer guide area 1 and a fuser area 2 for heating the papers passing therethrough and fusing carbon powders on the papers. Then, papers are transferred to the paper receiving tray 5 by sliding over the paper guide 3.

The paper turnover device of the above conventional printer comprises a rear door (or paper receiving tray 4) and a paper guide 3. The construction of the paper guide 3 is shown in FIG. 2. As shown in FIG. 2, a plurality of claws 32 are fixed, in an, equally-spaced manner, on a solid shaft 31. The claws 32 are used for guiding papers being transferred to move upward or downward. A crank 33 is fixed on the left end portion of the shaft 31, and a coil spring 34 is accommodated within the crank 33 in such a way that one leg of the spring 34 is restrained by the inner wall of the housing of printers, and the other leg of the spring 34 is engaged with the crank 33. By this arrangement, the paper receiving tray 4 is capable of driving the claws 32 to rotate about the shaft 31 for a predetermined angular displacement. In other words, as shown in FIG. 3*a*, when the paper receiving tray 4 is not in contact with the crank 33, papers being transferred in the direction A will slide over the upper surface 32*a* of the claws 32 and move upward. When the paper receiving tray 4 is turned to a horizontal attitude (see FIG. 3*b*), the crank 33 will be urged by the paper receiving tray 4 to rotate in the direction B, and thus the claws will be driven to rotate a predetermined angle. At this state, papers being transferred in the direction C (same as direction A) will be guided by the bottom surface 32*b* of the claws 32 and move in the direction D toward the paper receiving tray 4.

As described above, the paper guide 3 comprises a lot of parts such as the claws 32, the coil spring 34, etc.. However, too many parts will incur high cost. Furthermore, it is time consuming to assemble the paper guide 3.

SUMMARY OF THE INVENTION

The primary object of the present invention is to eliminate the disadvantages of the prior art described above, and to provide a paper turnover apparatus which is low cost, easy to operate, compact and light in weight.

It is another object of this invention to provide a paper turnover apparatus which is suitable for mass production.

In order to accomplish the above-mentioned objects, the present invention provides a paper turnover apparatus in a printer, for guiding printed papers to move toward a first paper receiving tray/a second paper receiving tray so as to pile the printed papers thereon with face down/up, which apparatus comprising: a shaft disposed within the printer and capable of being pivotally rotated around its longitudinal axis; a guiding means fixed on the shaft, having a first guide surface for guiding printed papers to move toward the first paper receiving tray and a second guide surface for guiding printed papers to move toward the second paper receiving tray, the first and second guide surfaces disposed in such a way that only one of the first and second guide surfaces, in one time, is guided to face printed papers when the shaft is pivotally rotated around its longitudinal axis; and a crank integrally formed on the shaft and capable of being urged by the first paper receiving tray, characterized in that: the gravitation center of the guiding means and the shaft is eccentric to the longitudinal axis of the shaft, so that the gravitational force of the guiding means and the shaft always drive the shaft to rotate to a first attitude that the first guide surface faces printed papers to guide the printed papers to move toward the first paper receiving tray, and the crank will guide the shaft to rotate to a second attitude that the second guide surface faces printed papers to guide the printed papers to move toward the second paper receiving tray when the first paper receiving tray urges the crank.

BRIEF DESCRIPTION OF THE DRAWINGS

The present invention can be more fully understood by reference to the following description and accompanying drawings, which form an integral part of this application:

FIG. 3*a* is a simplified diagram showing that the paper receiving tray is not in contact with the crank of the paper guide, and printed papers are being guided to move upward;

FIG. 3*b* is a simplified diagram showing that the paper receiving tray is urging the crank of the paper guide, and printed papers are being guided to move downward;

DETAILED DESCRIPTION OF THE PREFERRED EMBODIMENTS

Figure 4:
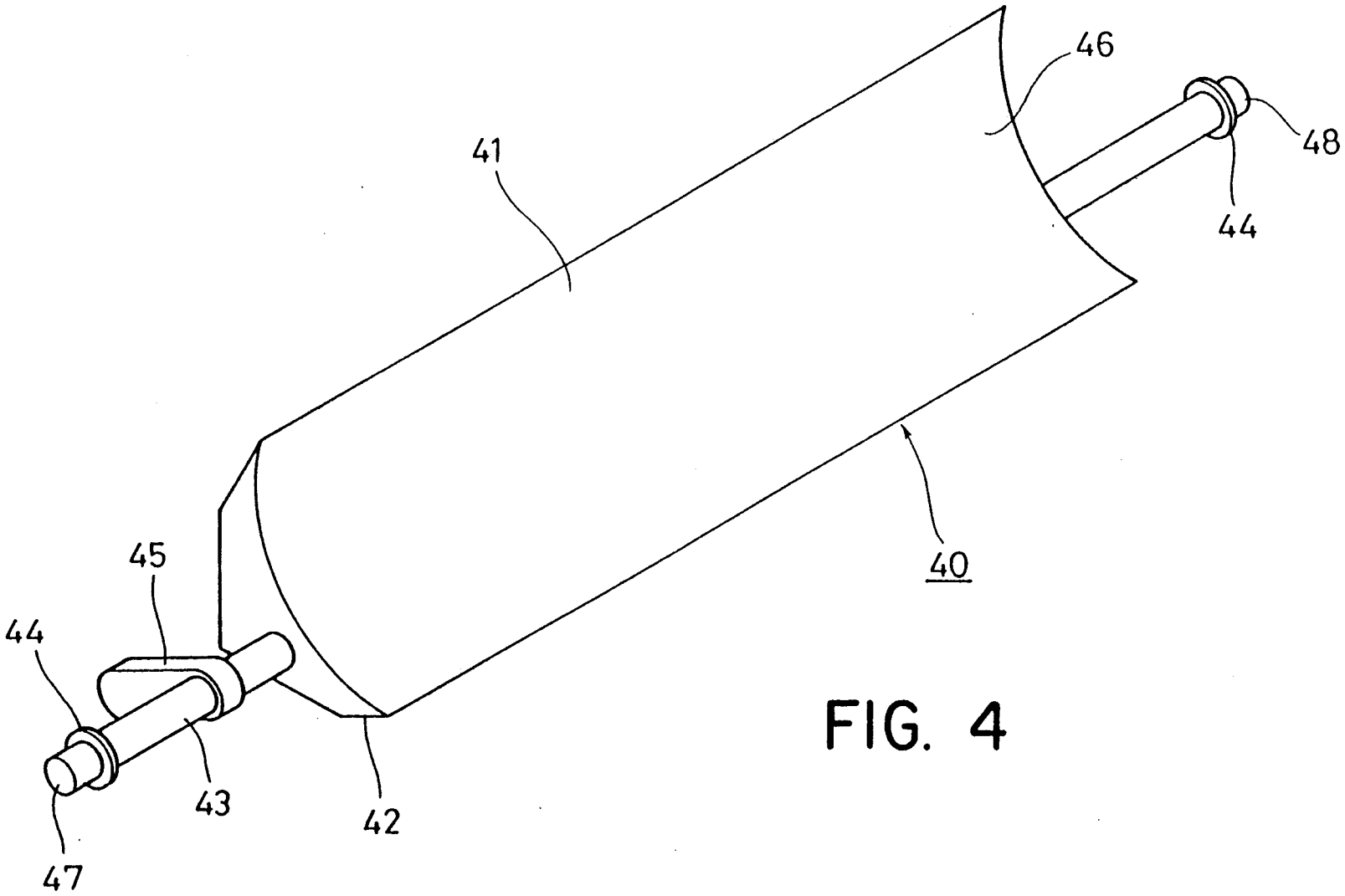
FIG. 4 is a perspective view showing the construction of the paper guide according to the present invention.
Figure 5A:
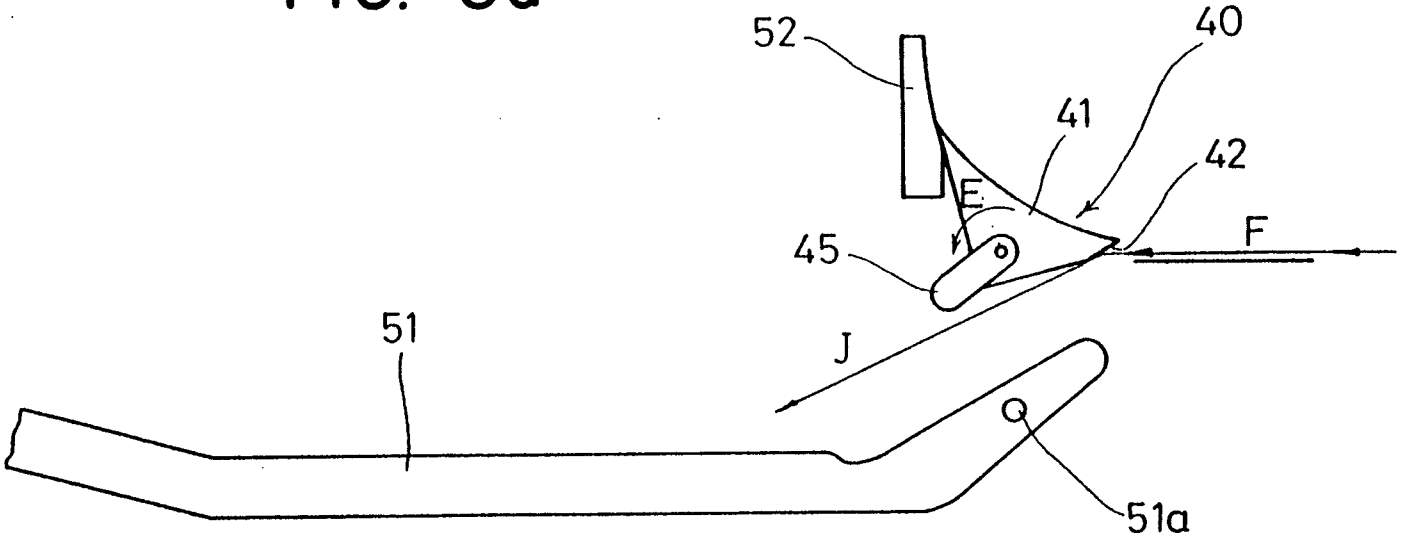
FIG. 5*a* is a simplified diagram showing a preferred embodiment of the paper guide according to this invention, in which the paper receiving tray is not in contact with the crank of the paper guide, and printed papers are being guided to move downward.
Figure 5B:
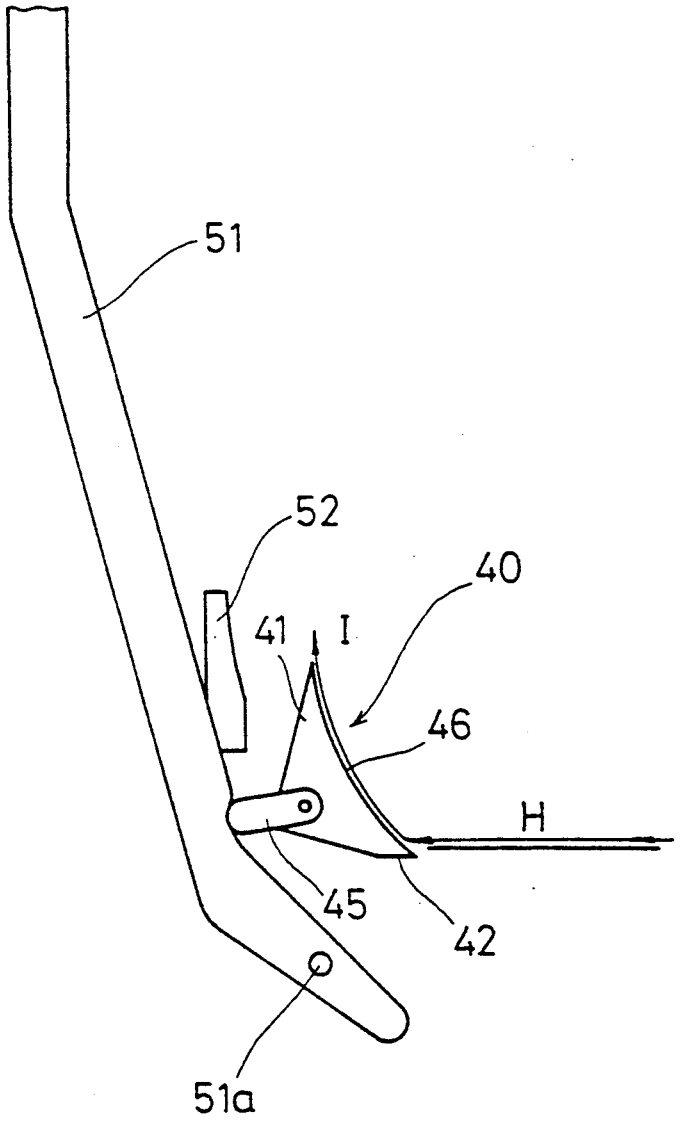
FIG. 5*b* is a simplified diagram showing a preferred embodiment of the paper guide shown in FIG. 5*a*, in which the paper receiving tray is urging the crank of the paper guide, and printed papers are being guided to move upward.

FIG. 4 is a perspective view showing the construction of the paper guide 40 of this invention, which is pivotally connected to the casing of a printer at its two end portions 47, 48. As shown in FIG. 4, the paper guide 40 comprises a guide block 41 having an upper curved guide surface 46 for guiding papers being transferred to move upward and to pile on a paper receiving tray (not shown) disposed above the paper guide 40 with face down. Furthermore, a flat guide surface 42 is provided on the bottom of the guide block 41, for guiding papers being transferred to move downward and to pile on the paper receiving tray 51 (see FIG. 5*a*) with face up. One pair of limitation collars 44 for preventing the shifting of the shaft 43 are integrally formed at two end portions 47, 48 of the shaft 43. Furthermore, a crank 45 is integrally formed on the left end portion of the shaft 43. The guide block 41 is integrally formed on the shaft 43 in such a way that the gravitation center G of the guide block 41 is eccentric to the axis of the shaft 43 (see FIG. 6). By this, as shown in FIG. 5*a*, when the crank 45 is not engaged with the paper receiving tray 51, the guide block 41 will rotate in the direction E to contact the inner wall of the bicover 52 fastened to the casing of the printer, and papers being transferred coming in the direction F will be guided by the guide surface 42 to move in the direction J and then to pile on the paper receiving tray 51 with face up. However, if the paper receiving tray 51 is rotated about the axis 51*a* to engage with the crank 45 (see FIG. 5*b*), papers being transferred coming in the direction H will be guided by the guide surface 46 to move in the direction H and finally to pile on a paper receiving tray disposed above the paper guide 40 with face down. It is preferable that the angle between the guide surface 42 and the moving direction J of the printed papers is ranging from 15° to 25°.

Figure 6:
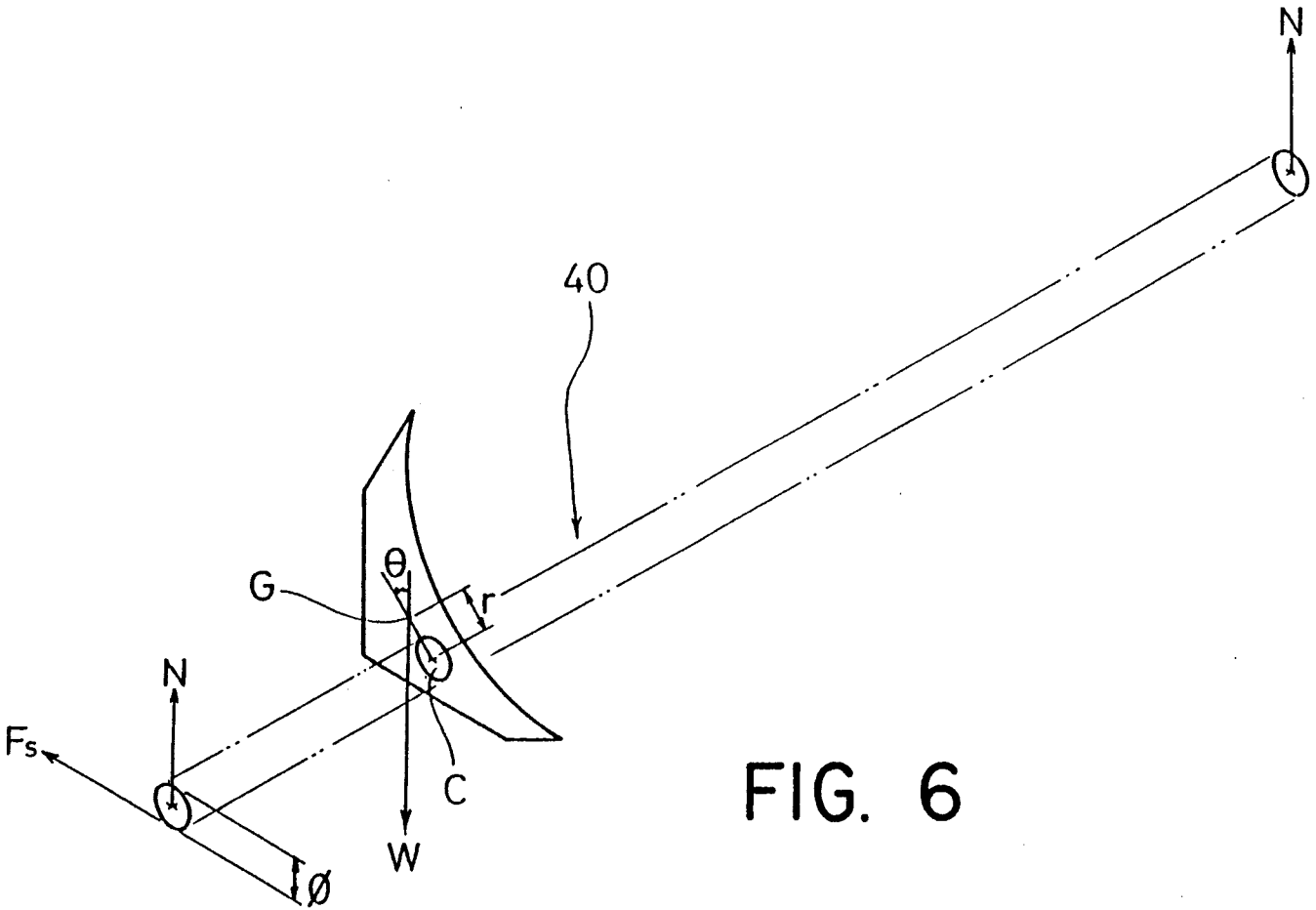
FIG. 6 is a diagram showing how the gravitational forces are exerted on the paper guide of this invention.

FIG. 6 is a diagram showing how the gravitational forces exert on the paper guide 40. If the total weight of the guide block 41 and the shaft 43 is W, then $$W=2N,$$

wherein N is the reaction forces at two end portions of the shaft 43.

The rotational torque $T_1$ about the axis of the shaft 43 induced by the weight W is $W * r * \sin\theta$. That is, $$T_1 = W*r*\sin\theta.$$

wherein r is the distance between the axis of the shaft 43 and the gravitation center G of the guide block 41 and the shaft 43, and $\theta$ is the angle between the action line of the gravitational force W and the line section GC (see FIG. 6).

The frictional torque $T_2$ induced by frictional forces at two end portionts of the shaft 43 is $2 * F_s * (0.5 * \phi)$. That is, $$T_2=2*F_s*(0.5*\phi),$$

wherein $F_s$ is the maximum static frictional force whose value is $\mu_s * N$, and $\phi$ is the diameter of the shaft 43.

Thus, the resultant torque $T_r$ can be expressed as:

$$\begin{aligned} T_r &= T_1 - T_2 \\ &= W * r * \sin\theta - F_s * \phi \end{aligned}$$

Figure 1A:
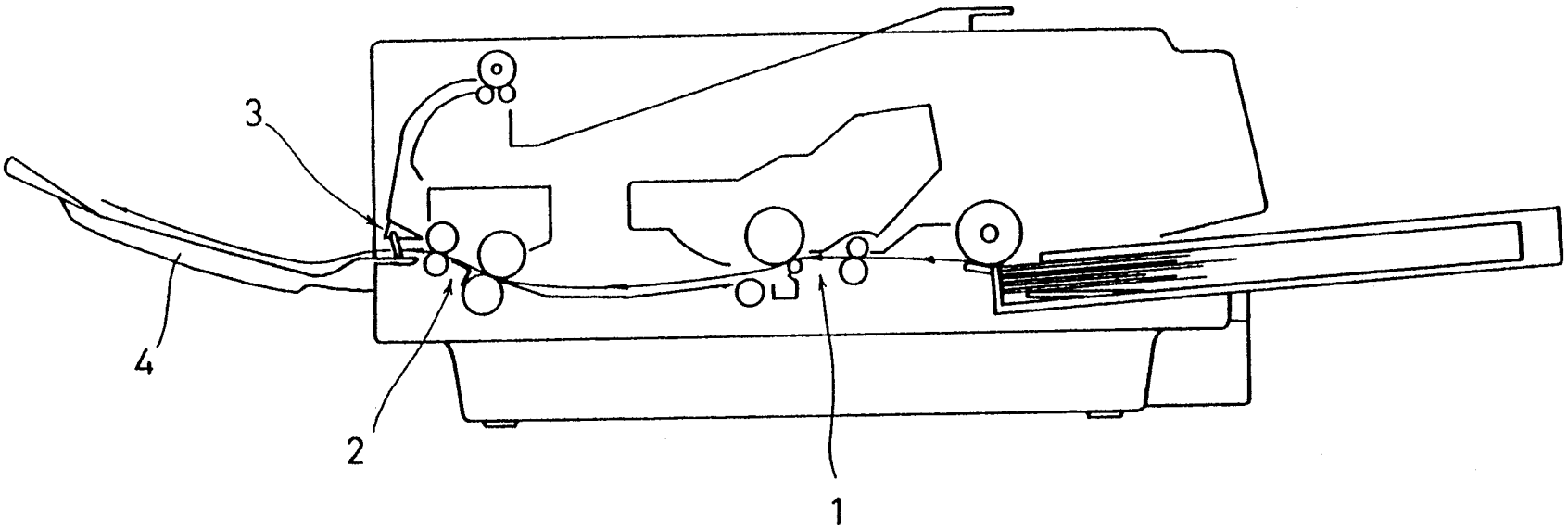
FIG. 1a (PRIOR ART)
FIG. 1*a* is a simplified diagram showing that papers to be printed are being transferred through a conventional printer and being disposed in a paper receiving tray with face up.
Figure 1B:
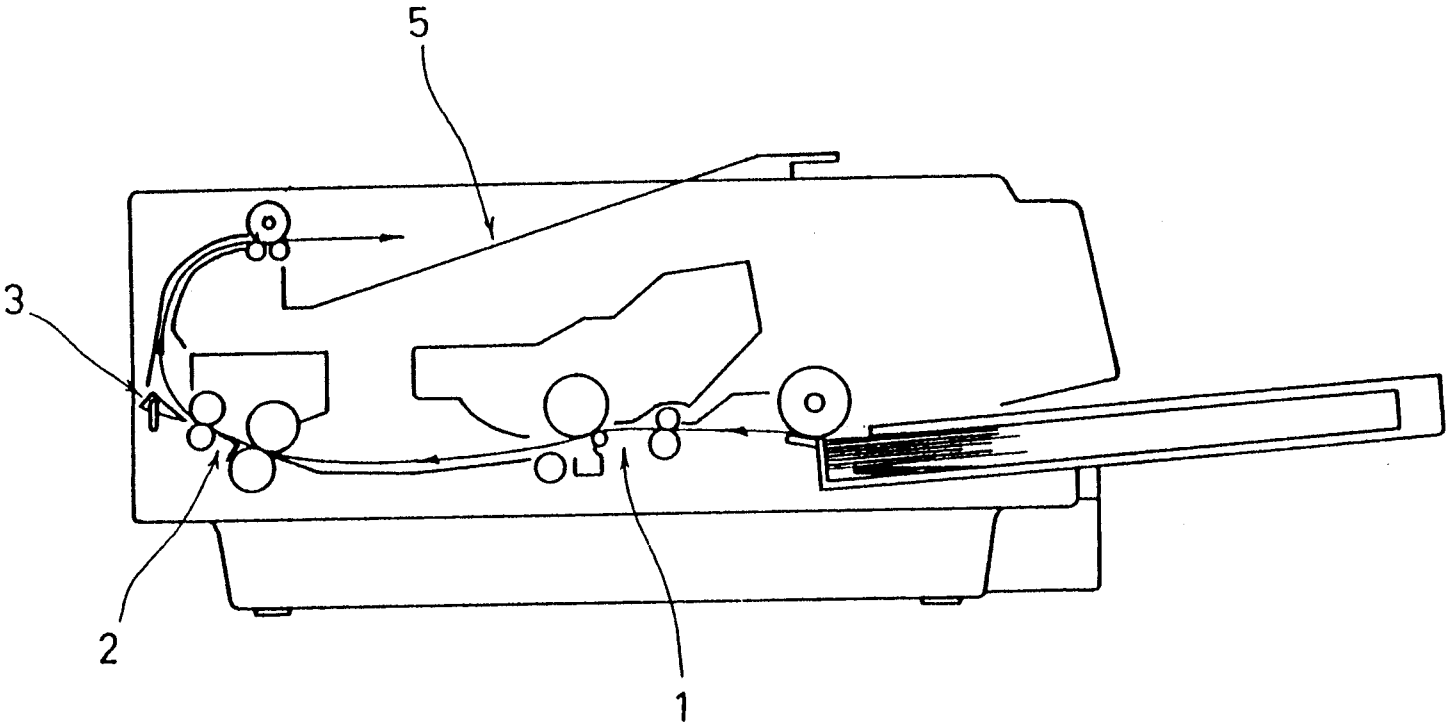
FIG. 1b (PRIOR ART)
FIG. 1*b* is a simplified diagram showing that papers to be printed are being transferred through a conventional printer and being disposed in a paper receiving tray with face down.
Figure 2:
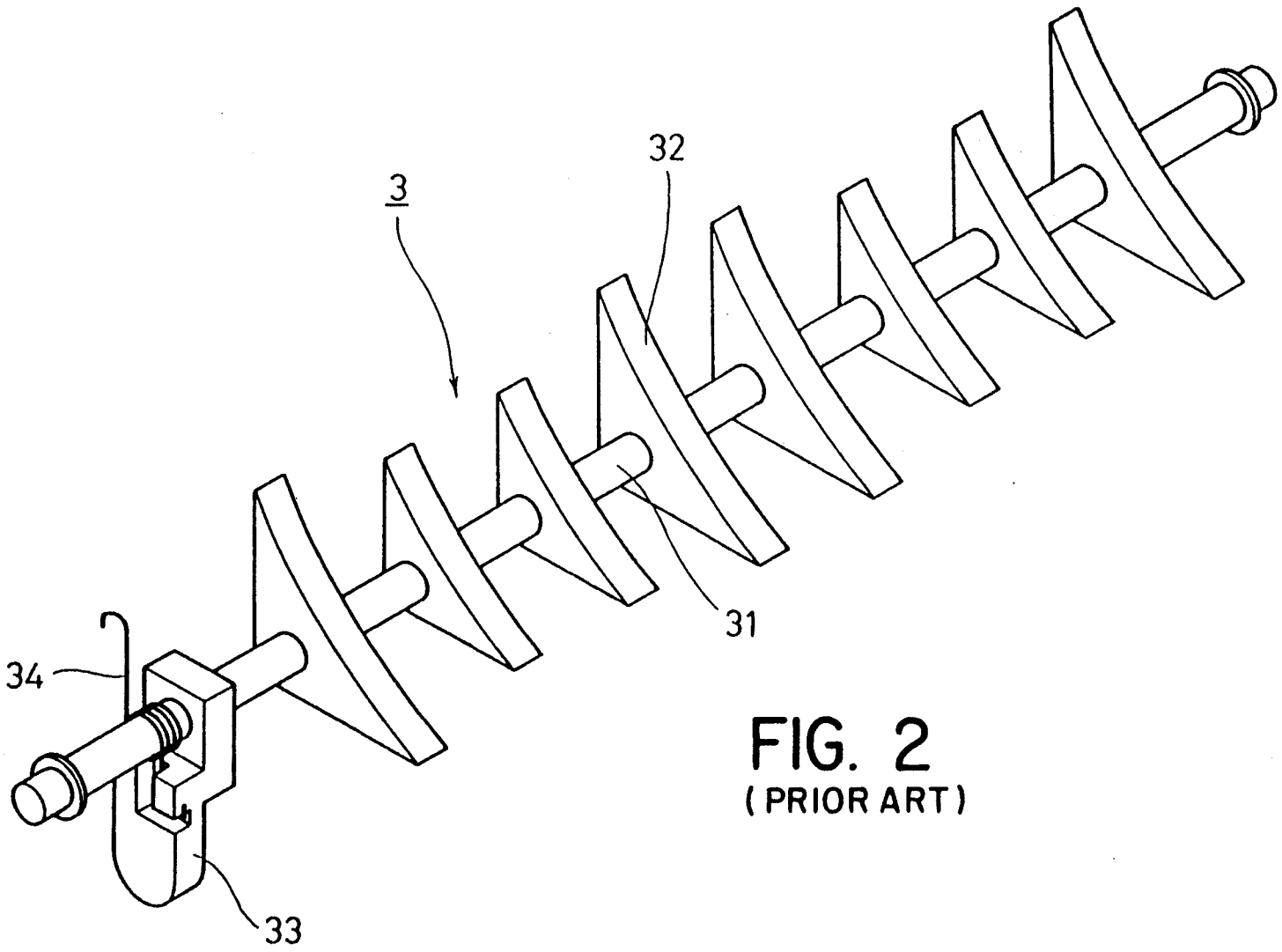
FIG. 2 (PRIOR ART)
FIG. 2 is a perspective view showing the construction of the paper guide.

If we choose the values of W, r, $\sin\theta$, $F_s$, and $\phi$ in such a way that the value of $T_r$ become positive, then the guide block 41 will always rotate toward the bicover 52 (see FIG. 5*a*), and urging means such as coil spring 34 in conventional printers (see FIG. 2) can be omitted.

As described above, the guide block 41 of the present invention can automatically guide printed papers to move downward without any urging means. Therefore, the paper turnover apparatus according to this invention can be manufactured at lower cost.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A paper turnover apparatus in a printer, for selectively guiding printed papers to move toward a first paper receiving tray and stacking the papers face up or to move the papers toward a second paper receiving tray and stacking the papers face down, comprising:

a guiding means mounted for rotation about a longitudinal axis and having a first guide surface for guiding the papers to move toward the first tray and a second guide surface for guiding the papers to move toward the second tray, said first and second guide surfaces disposed in such a way that only one of said first and second guide surfaces at a time faces the papers when said guiding means is rotated around the longitudinal axis;

said guiding means having a center of gravity which is sufficiently eccentric to the longitudinal axis such that the weight of the guiding means overcomes frictional forces opposing rotation of said guiding means, whereby said guiding means always rotates by force of gravity to a first attitude in which the first guide surface faces the papers when the first tray is moved to an open position; and means defining a contact surface mounted irrotatably with respect to said guiding means and positioned to be engaged by the first tray when the first tray is moved toward a closed position, whereby said contact surface means urges said guiding means to rotate to a second attitude in which the second guide surface faces the papers when engaged by the first tray.

2. A paper turnover apparatus as in claim 1, wherein said guiding means and said contact surface means are integrally formed.

3. A paper turnover apparatus as in claim 1 or claim 2, wherein the angle between the first guide surface and the moving direction of the papers is in the range of 20°±5°.

* * * * *